US008635320B2

(12) United States Patent
Ishizaka

(10) Patent No.: US 8,635,320 B2
(45) Date of Patent: Jan. 21, 2014

(54) AIR CONDITIONING MANAGEMENT APPARATUS AND AIR CONDITIONING MANAGEMENT SYSTEM

(75) Inventor: Taichi Ishizaka, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 252 days.

(21) Appl. No.: 12/866,841

(22) PCT Filed: Mar. 28, 2008

(86) PCT No.: PCT/JP2008/056009

§ 371 (c)(1),
(2), (4) Date: Aug. 9, 2010

(87) PCT Pub. No.: WO2009/118877

PCT Pub. Date: Oct. 1, 2009

(65) Prior Publication Data

US 2010/0325270 A1 Dec. 23, 2010

(51) Int. Cl.
*G06F 15/173* (2006.01)
*H04L 9/28* (2006.01)

(52) U.S. Cl.
USPC ..... 709/223; 709/224; 700/276; 713/173

(58) Field of Classification Search
USPC ..... 709/223–224; 713/173; 700/276
See application file for complete search history.

(56) References Cited

U.S. PATENT DOCUMENTS 5,566,333 A * 10/1996 Olson et al. ..... 1/1
6,038,486 A * 3/2000 Saitoh et al. ..... 700/96
6,182,857 B1 * 2/2001 Hamm et al. ..... 221/2
6,618,709 B1 * 9/2003 Sneeringer ..... 705/412
7,089,307 B2 * 8/2006 Zintel et al. ..... 709/224
7,529,350 B2 * 5/2009 Light et al. ..... 379/42
2001/0030597 A1 * 10/2001 Inoue et al. ..... 340/3.7
2002/0029096 A1 3/2002 Takai et al.
2002/0104323 A1 8/2002 Rash et al.

(Continued)

FOREIGN PATENT DOCUMENTS

CN 1247596 A 3/2000
CN 1877209 A 12/2006

(Continued)

OTHER PUBLICATIONS

International Search Report (PCT/ISA/210) for PCT/JP2008/056009 dated May 13, 2008.
Office Action (Notification of Reasons for Refusal) dated May 8, 2012, issued in corresponding Japanese Patent Application No. 2010-505104, and an English Translation thereof. (4 pages).

(Continued)

*Primary Examiner* — Alina N. Boutah
(74) *Attorney, Agent, or Firm* — Buchanan Ingersoll & Rooney PC

(57) ABSTRACT

An air conditioning management apparatus is provided which can remotely monitor and control air conditioning equipment with ease of viewing a home page while securing security. The air conditioning management apparatus includes a facility equipment interface (230) connected to the air conditioning equipment, a remote interface (240) connected to a network, a facility equipment communication management unit (251) for communicating with the air conditioning equipment through the facility equipment interface (230) and obtaining operating state data showing an operating state of the air conditioning equipment, and a remote communication management unit (253) for creating an operating state file based on the contents of the operating state data and transmitting the operating state file to a destination on the network through a remote interface (240).

16 Claims, 11 Drawing Sheets

(56) References Cited

U.S. PATENT DOCUMENTS

| | | | | |
|---|---|---|---|---|
| 2004/0049320 | A1* | 3/2004 | Takai et al. | 700/278 |
| 2004/0071355 | A1* | 4/2004 | Liao et al. | 382/238 |
| 2004/0107717 | A1 | 6/2004 | Yoon et al. | |
| 2004/0158620 | A1* | 8/2004 | Ha et al. | 709/219 |
| 2004/0183722 | A1* | 9/2004 | Ueda et al. | 342/357.09 |
| 2004/0204793 | A1 | 10/2004 | Yoon et al. | |
| 2006/0064204 | A1* | 3/2006 | Kim et al. | 700/276 |
| 2006/0075096 | A1* | 4/2006 | Ueda et al. | 709/224 |
| 2006/0218267 | A1* | 9/2006 | Khan et al. | 709/224 |
| 2007/0055891 | A1* | 3/2007 | Plotkin et al. | 713/189 |
| 2007/0061460 | A1* | 3/2007 | Khan et al. | 709/225 |
| 2007/0073457 | A1* | 3/2007 | Lee | 701/29 |
| 2007/0157644 | A1* | 7/2007 | Kim et al. | 62/157 |
| 2008/0126557 | A1* | 5/2008 | Motoyama et al. | 709/232 |
| 2008/0148067 | A1* | 6/2008 | Sitrick et al. | 713/193 |
| 2009/0012650 | A1* | 1/2009 | Wang et al. | 700/276 |
| 2010/0217837 | A1* | 8/2010 | Ansari et al. | 709/218 |

FOREIGN PATENT DOCUMENTS

| | | | |
|---|---|---|---|
| EP | 1 429 082 | A2 | 6/2004 |
| EP | 1 429 083 | A1 | 6/2004 |
| JP | 7174397 | A | 7/1995 |
| JP | 2000-011280 | A | 1/2000 |
| JP | 2004-233118 | A | 8/2004 |
| JP | 2005-044369 | A | 2/2005 |
| JP | 2005-241227 | A | 9/2005 |

OTHER PUBLICATIONS

Office Action from Chinese Patent Office dated Sep. 29, 2012, issued in corresponding Chinese Patent Application No. 200880128101.X, with English translation thereof.

The extended Search Report from European Patent Office dated Nov. 7, 2013, issued in corresponding European Patent Application No. 08739133.0. (7 pages).

* cited by examiner (a) MONITOR OF OPERATING STATE OF placeStateAIR CONDITIONING EQUIPMENT 100

(b) CONTROL OF AIR CONDITIONING EQUIPMENT 100

| Address, | ON/OFF, | Mode, | SetTemp, | InletTemp, | FanSpeed |
|---|---|---|---|---|---|
| 1, | ON, | HEAT, | 19.0, | 18.5, | HIGH |
| 2, | OFF, | HEAT, | 21.0, | 20.5, | LOW |
| 3, | ON, | HEAT, | 22.0, | 22.5, | LOW |
| | | | ∘ | | |
| | | | ∘ | | |

(a) EXAMPLE 1 OF CONTROL COMMAND FILE

```
Address="1", ON/OFF="OFF"
Address="3", ON/OFF="OFF"
```

(b) EXAMPLE 2 OF CONTROL COMMAND FILE

```
Address="1", Week="MON",  Time="8:00", ON/OFF="ON"
Address="1", Week="MON",  Time="21:00", ON/OFF="OFF"
```

AIR CONDITIONING MANAGEMENT APPARATUS AND AIR CONDITIONING MANAGEMENT SYSTEM

TECHNICAL FIELD

The present invention relates to an air conditioning management apparatus for controlling operations of air conditioning equipment and an air conditioning management system for managing air conditioning equipment through a network.

BACKGROUND ART

As to a disaster prevention monitor system, there is conventionally proposed "a disaster monitor system in which remote operation consoles 4*a* to 4*b* are installed in each of a plurality of monitor regions 1*a* to 1*n* of a building and the like, a home page is provided on which disaster information collected by disaster monitor consoles 3*a* to 3*n* of disaster prevention facilities 2*a* to 2*n* is published so that the disaster prevention information published on the home page is browsed via the Internet 5 by a browser of a remote monitor device 7 having an access right to the home page" as a technology having an object of "collectively and simply managing far located disaster prevention facilities at low cost by effectively using a home page browsing function of the Internet" (Patent Document 1).

Patent Document 1

Japanese Patent Application Laid-Open No. 2000-11280 (Abstract)

DISCLOSURE OF THE INVENTION

Problems to be Solved by the Invention

In the technology disclosed in Patent Document 1, since the remote operation consoles are provided with the home page and directly published on the Internet, a cost and the like are necessary to construct a high security arrangement capable of withstanding a mischief operation, an attack, and the like from a malicious user on the Internet.

Further, since each of the remote operation consoles must make use of one global IP address (IP address specific on the Internet), a running cost is required.

The present invention is proposed to solve such problems as described above and is directed at providing an air conditioning management apparatus capable of remotely monitoring and controlling air conditioning equipment with ease of viewing a home page while securing security.

Mean for Solving the Problems

An air conditioning management apparatus of the present invention is an air conditioning management apparatus for controlling operation of air conditioning equipment and includes a facility equipment interface connected to the air conditioning equipment; a remote interface connected to a network; a facility equipment communication management unit for communicating with the air conditioning equipment through the facility equipment interface and obtaining operating state data showing an operating state of the air conditioning equipment; and a remote communication management unit for creating an operating state file based on the contents of the operating state data and transmitting the operating state file to a predetermined destination on the network through the remote interface.

Effects of the Invention

According to the air conditioning management apparatus in accordance with an aspect of the invention, since an operating state file is transmitted to a destination on a network from the air conditioning management apparatus, it is sufficient for a manager to browse the operating state file transmitted to the destination through the Internet, and it is not necessary to publish the network itself, to which the air conditioning equipment and the air conditioning management apparatus are connected, to the Internet.

Accordingly, since the air conditioning management apparatus does not receive a mischief and an attack from a malicious user on the Internet, the air conditioning management apparatus is safe from a view point of an information security.

EXPLANATION OF REFERENCE NUMERALS

30 the Internet, 100*a* to 100*b* air conditioning equipment, 110 controller, 120 sensor, 130 memory unit, 131 operating state data, 132 equipment type information, 140 communication management unit, 200*a* to 200*c* air conditioning management apparatus, 210 display unit, 220 input unit, 230 facility equipment interface, 240 remote interface, 250 controller, 251 facility equipment communication management unit, 252 local communication management unit, 253 remote communication management unit, 254 FTP communication management unit, 255 operation data transmission unit, 256 control command file receiving unit, 260 memory unit, 261 operating state data, 262 Web server setting, 263 data update setting, 264 manufacturing number, 300 local monitor terminal, 400 Web server, 410 remote interface, 420 controller, 421 HTTP communication management unit, 422 FTP communication management unit, 430 memory unit, 431 Web screen display file, 432 monitor control program, 433 operating state file, 434 control command file, 500 remote monitor terminal, 510 display unit, 520 input unit, 530 remote interface, 540 controller, 541 HTTP communication management unit, 542 FTP communication management unit, 543 display controller, 544 monitor control program controller, 550 monitor control program, 551 operation data receiving portion, 552 control command data transmitting portion, 553 display control portion, 554 data storage unit, 560 memory unit, 561 operating state file, 562 data collection setting, 563 monitor target setting, 564 display setting unit.

BEST MODE FOR CARRYING OUT THE INVENTION

Embodiment 1

Figure 1:
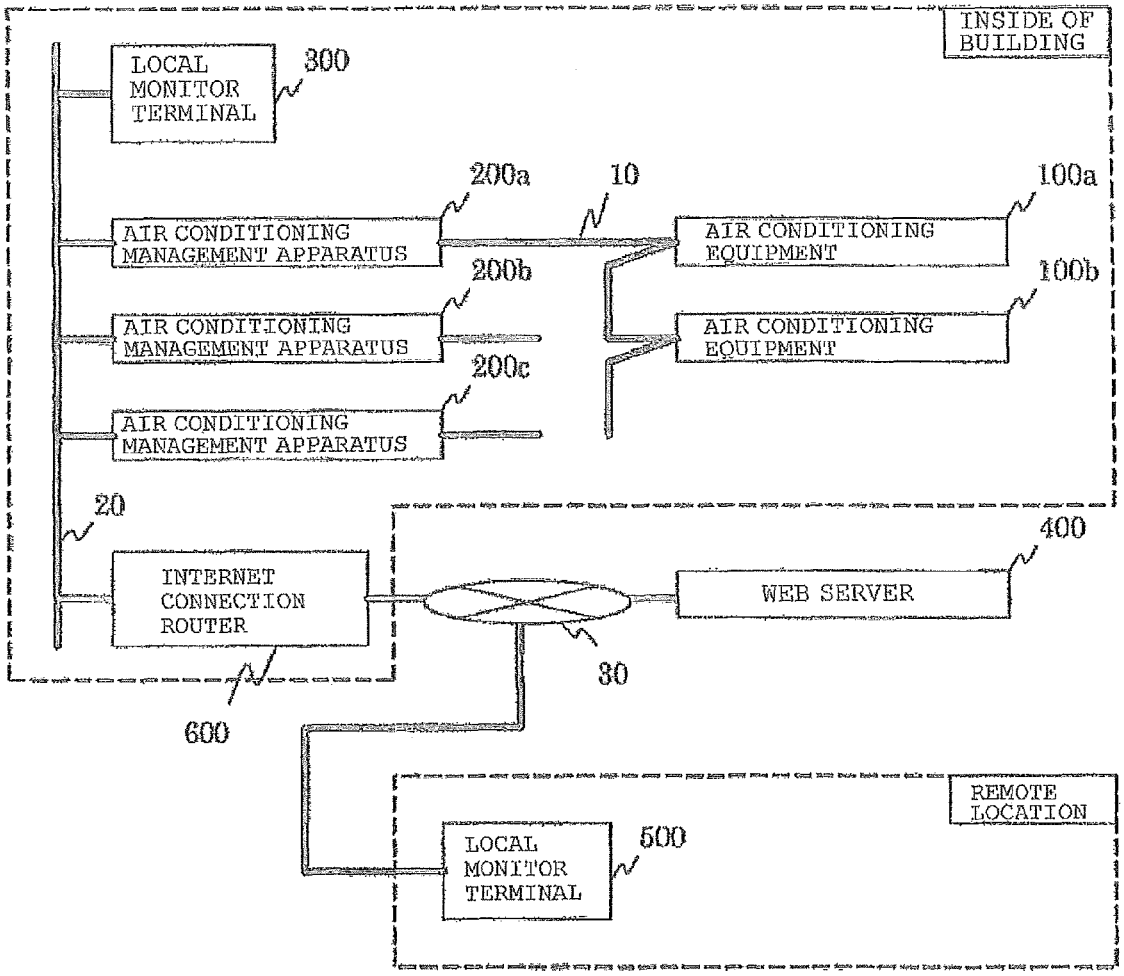
FIG. 1 is an arrangement view of an air conditioning management system according to an embodiment 1.

FIG. 1 is an arrangement view of an air conditioning management system according to an embodiment 1 of the invention.

The air conditioning management system according to the embodiment 1 includes air conditioning equipment 100*a* to 100*b*, air conditioning management apparatuses 200*a* to 200*c*, and a local monitor terminal 300 in a facility having at least one building. Further, the air conditioning management system includes a Web server 400 connected thereto through the Internet 30 and a remote monitor terminal 500 in a remote location connected thereto through the Internet 30 likewise.

The air conditioning equipment 100*a* to 100*b* and the air conditioning management apparatuses 200*a* to 200*c* have the same arrangements, respectively. Hereinafter, they are generically called air conditioning equipment 100, an air conditioning management apparatus 200, and the like respectively.

The air conditioning equipment 100 and the air conditioning management apparatus 200 are connected to each other by a dedicated communication line 10 and can transmit and receive data through communication.

The air conditioning management apparatuses 200*a* to 200*c* and the local monitor terminal 300 are connected to each other through a LAN 20 and can transmit and receive data through communication. Further, the LAN 20 is connected to the Internet 30 through an Internet connection router 600.

The air conditioning equipment 100 corresponds to "the air conditioning equipment" in the embodiment 1.

The air conditioning management apparatus 200 is an apparatus for integrally monitoring and controlling a plurality of air conditioning equipment 100.

The local monitor terminal 300 is composed of a general purpose personal computer on which a Web browser is operated. A user can monitor and set an operating state, abnormal information, various operation data of the air conditioning equipment on the Web browser of the local monitor terminal 300.

The Web server 400 is a server for publishing a Web page on the Internet and includes a memory means such as a HDD (Hard Disk Drive) for storing an operating state file and a control command file to be described later.

The local monitor terminal 500 can be composed of a general purpose personal computer on which the Web browser is operated. The user can access the Internet 30 using the Web browser of the remote monitor terminal 500 and monitors and controls the air conditioning equipment 100. A specific method will be described later.

Respective equipment connected to the LAN 20 under the Internet connection router 600 is allocated with private IP addresses.

The Internet connection router 600 executes NAT (Network Address Translation) when relaying a packet to the Internet 30 from the LAN 20 thereunder.

With this operation, the respective equipment connected to the LAN 20 can be connected to the Internet 30 through the Internet connection router 600.

With the network arrangement described above, the air conditioning management apparatus 200 and the local monitor terminal 300 can be connected to the Web server 400 through the Internet connection router 600 and the Internet 30 and obtain a file stored in the Web server 400.

In contrast, it is impossible to be connected to the LAN 20 under the Internet connection router 600 from the Internet 30 side.

In the air conditioning management system according to the embodiment 1, since the network arrangement described above is employed from a view point of network security, the remote monitor terminal 500 cannot directly obtain an operating state and the like of the air conditioning equipment 100.

The air conditioning management system according to the embodiment 1 uses a method shown in FIG. 2 to be explained later to monitor and control the air conditioning equipment 100 from the remote monitor terminal 500.

Figure 2:
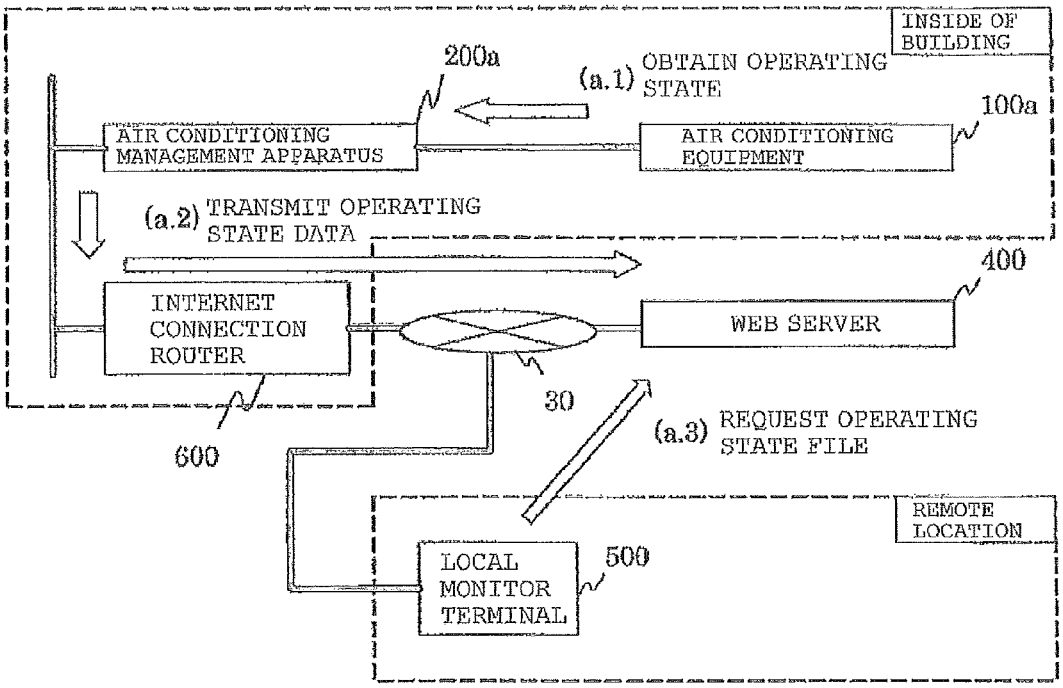
FIG. 2 is a view explaining a method of monitoring and controlling air conditioning equipment 100 from a remote monitor terminal 500.
Figure 2:
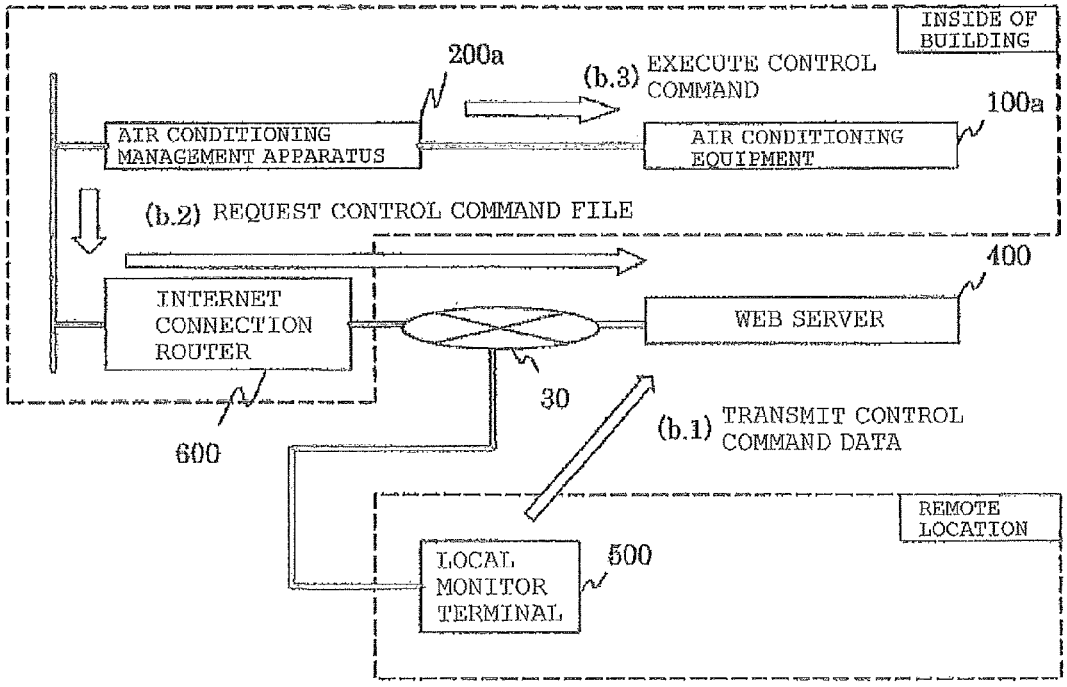

FIG. 2 is a view explaining the method of monitoring and controlling the air conditioning equipment 100 from the remote monitor terminal 500. Respective procedures of FIG. 2 will be explained below. Arrangements and reference numerals shown in FIG. 1 are partly omitted in FIG. 2.

(a) Monitoring of Operating State of Air Conditioning Equipment 100

(a. 1) The air conditioning management apparatus 200 periodically obtains operating states of the air conditioning equipment 100. When an operating state of the air conditioning equipment 100 changes, a content of the change may be automatically notified from the air conditioning equipment 100 to the air conditioning management apparatus 200.

(a. 2) The air conditioning management apparatus 200 transmits the operating states of the air conditioning equipment 100 to the Web server 400 as operating state files. The operating state files may be periodically transmitted or may be transmitted only when an operating state of the air conditioning equipment 100 changes. The Web server 400 stores the operating state files in the memory means.

(a. 3) The user access the Web server 400 using the Web browser of the remote monitor terminal 500 and requests to transmit the operating state files. The user monitors the operating states of the air conditioning equipment 100 by browsing the obtained operating state files on the Web browser.

(b) Control of Air Conditioning Equipment 100

(b. 1) The user inputs a control command to the air conditioning equipment 100 using the Web browser of the remote monitor terminal 500. The remote monitor terminal 500 creates control command files based on the input and transmits the control command files to the Web server 400. The Web server 400 stores the control command files in the memory means.

(b. 2) The air conditioning management apparatus 200 periodically requests the Web server 400 to transmit the control command files stored in the Web server 400.

(b. 3) The air conditioning management apparatus 200 executes control commands instructed in the obtained control command files and controls the air conditioning equipment 100.

The contents of control performed from the remote monitor terminal 500 can be arbitrarily arranged.

The content may be, for example, an operation to the air conditioning equipment 100, setting of a schedule and energy saving to the air conditioning management apparatus 200, and an instruction to the air conditioning management apparatus 200 to periodically obtain operating states of the air conditioning equipment 100.

According to the remote monitoring and control method explained in FIG. 2, it is not necessary to permit an access from the Internet 30 side to the air conditioning equipment 100 and the air conditioning management apparatus 200, and the air conditioning equipment 100 can be monitored and controlled from the remote monitor terminal 500 only by permitting an access from the air conditioning management apparatus 200 to the Web server.

Although the example for monitoring and controlling the air conditioning equipment 100 from the remote monitor terminal 500 is explained in the embodiment 1, the air conditioning management apparatus 200 can be also monitored and controlled by the same procedures. This is also the same in the following embodiments.

As described above, in the air conditioning management system according to the embodiment 1, a network in a building is arranged to prevent, the LAN 20 from being accessed from the Internet 30 by allocating the private IP addresses to the respective equipment connected to the LAN 20.

With this operation, the network security of the respective equipment can be more enhanced than a network arrangement in which the air conditioning equipment 100 and the air conditioning management apparatus 200 connected to the LAN 20 is directly accessed from the Internet 30.

Further, in the air conditioning management system according to the embodiment 1, the air conditioning management apparatus 200 periodically obtains operating state data showing the operating states of the air conditioning equipment 100 and transmits the operating state data to the Web server 400, and the remote monitor terminal 500 obtains the operating state files stored in the Web server 400 and obtains the operating states of the air conditioning equipment 100.

With these operations, since the remote monitor terminal 500 can monitor the operating states of the air conditioning equipment 100 without directly accessing the LAN 20, the air conditioning equipment 100 can be remotely monitored while keeping the network security of the respective equipment connected to the LAN 20.

Further, in the air conditioning management system according to the embodiment 1, the remote monitor terminal 500 transmits the control command files, in which the control commands to the air conditioning equipment 100 are written, to the Web server 400, and the air conditioning management apparatus 200 periodically obtains the control command files stored in the Web server 400 and controls the air conditioning equipment 100.

With these operations, since the remote monitor terminal 500 can control the air conditioning equipment 100 without directly accessing the LAN 20, the air conditioning equipment 100 can be remotely controlled while keeping network security of the respective equipment connected to the LAN 20.

Embodiment 2

In the embodiment 1, the network arrangement of the air conditioning management system according to the invention, and the remote monitor and the control method have been explained.

An embodiment 2 of the present invention will explain an example of detailed arrangements and operations of respective equipment constituting an air conditioning management system.

Figure 3:
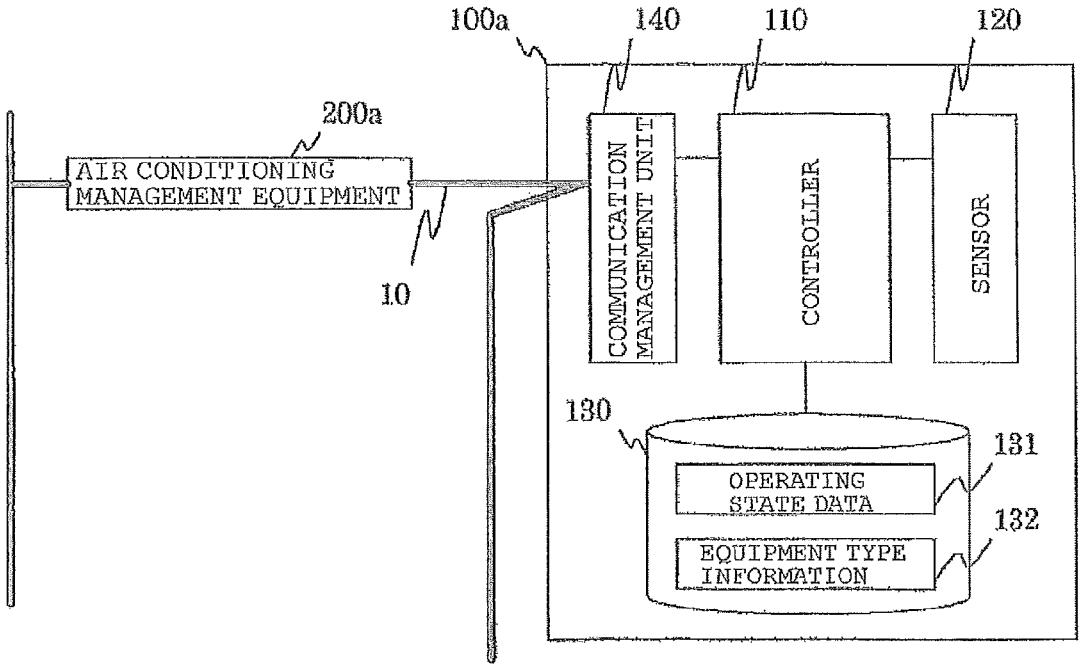
FIG. 3 is a function block diagram of the air conditioning equipment 100.

FIG. 3 is a function block diagram of an air conditioning equipment 100. Although FIG. 3 shows the function block diagram of an air conditioning equipment 100*a*, an air conditioning equipment 100*b* also has the same arrangement.

The air conditioning equipment 100 includes a controller 110, a sensor 120, a memory unit 130, and a communication management unit 140.

The controller 110 controls an ordinary operation of the air conditioning equipment 100 as well as controls an operating state reflecting a result of detection of the sensor 120. Further, the controller 110 creates operating state data 131 showing an operating state of the air conditioning equipment 100 using the result of detection of the sensor 120 and stores them in the memory unit 130.

The operating state data 131 is created when the operating state changes or at an appropriately determined timing such as a predetermined time interval.

The sensor 120 detects the temperature, the pressure, and the like of respective portions of the air conditioning equipment 100.

The memory unit 130 stores the operating state data 131 and equipment type information 132 of the air conditioning equipment 100. The equipment type information 132 may be previously stored in the memory unit 130 or may be set by an input and the like from a user.

The communication management unit 140 communicates with an air conditioning management apparatus 200.

The controller 110 can be composed of hardware such as a circuit device for realizing the function of the controller 110 or can be also composed of an arithmetic operation device such as a microcomputer and a CPU (Central Processing Unit) and software for prescribing the operation of the arithmetic operation device.

The memory unit 130 can be composed of a memory device such as a HDD and a flash ROM (Read Only Memory).

The communication management unit 140 includes a communication interface necessary to be connected to the air conditioning management apparatus 200.

Figure 4:
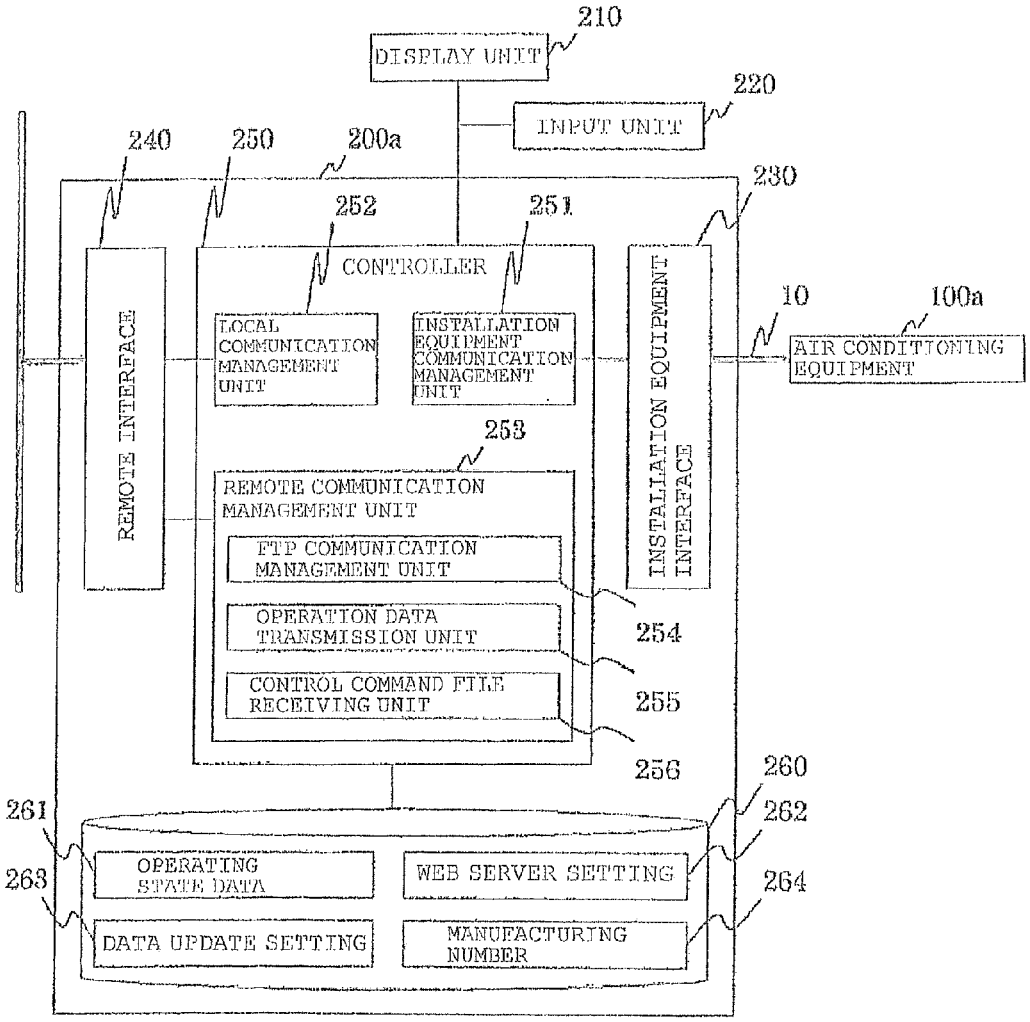
FIG. 4 is a function block diagram of an air conditioning management apparatus 200.

FIG. 4 is a function block diagram of the air conditioning equipment 200. Although FIG. 4 shows a function block diagram of an air conditioning equipment 200*a*, the other air conditioning equipment also have the same arrangement.

The air conditioning management apparatus 200 is an apparatus for integrally monitoring and controlling the air conditioning equipment 100 disposed in facilities having at least one building and includes a display unit 210, an input unit 220, a facility equipment interface 230, a remote interface 240, a controller 250, and a memory unit 260.

The display unit 210 displays the operating state of the air conditioning equipment 100 on a screen.

The input unit 220 is a unit for a user to switch a monitor screen and to input an operation of the air conditioning equipment 100.

The facility equipment interface 230 is a communication interface for connecting the air conditioning equipment 100 for communication.

The remote interface 240 is a communication interface connected to a LAN 20 to communicate with the local monitor terminal 300 and the Web server 400.

The controller 250 displays a screen for an ordinary operation, receives an input, and controls the operation of the air conditioning equipment 100. Further, the controller 250 controls communication with the air conditioning equipment 100, a local monitor terminal 300, and a Web server 400.

The memory unit 260 stores respective data to be described later.

The controller 250 includes a facility equipment communication management unit 251, a local communication management unit 252, and a remote communication management unit 253.

The facility equipment communication management unit 251 communicates with the air conditioning equipment 100 through the facility equipment interface 230, controls the operation of the air conditioning equipment 100, and further obtains operating state data and stores it in the memory unit 260.

The local communication management unit 252 communicates with the local management terminal 300 installed in the same building through the remote interface 240.

The remote communication management unit 253 transmits the operating state data to the Web server 400 and receives and analyzes a control command file.

The remote communication management unit 253 includes an FTP communication management unit 254, an operation data transmission unit 255, and a control command file receiving unit 256.

The FTP communication management unit 254 controls FTP communication with the Web server 400.

The operation data transmission unit 255 periodically transmits operating state data 261 obtained from the air conditioning equipment 100 to the Web server 400 through the FTP communication management unit 254.

The control command file receiving unit 256 receives the control command file, in which a control command to the air conditioning equipment 100 is described, from the Web server 400 through the FTP communication management unit 254 and analyzes its contents.

The memory unit 260 stores the operating state data 261, a Web server setting 262, a data update setting 263, and a manufacturing number 264.

The operating state data 261 is data showing the operating state of the air conditioning equipment 100.

The Web server setting 262 is a data file in which an IP address of the Web server 400, URL, and the like are recorded.

The data update setting 263 is a data file in which update setting of collection items and a collection cycle of respective data, timing at which the operating state data 261 is transmitted to the Web server 400, and the like are recorded.

The manufacturing number 264 is a data file in which a specific manufacturing number of the air conditioning management apparatus 200 is recorded. Specific numbers other than the manufacturing number, for example, a MAC address and a serial number may be used.

The facility equipment communication management unit 251 updates the operating state data 261 each time the facility equipment communication management unit 251 obtains a new operating state of the air conditioning equipment 100.

The Web server setting 262, the data update setting 263, and the manufacturing number 264 may be previously stored to the memory unit 260 or may be set by an input of the user.

The controller 250 and the respective components included in the controller 250 can be composed of hardware such as circuit devices for realizing the functions of the controller 250 and the respective components or can be also composed of arithmetic operation devices such as microcomputers and CPUs and software for prescribing the operations of the arithmetic operation devices.

The memory unit 260 can be composed of a memory device such as a HDD and a flash ROM.

Figure 5:
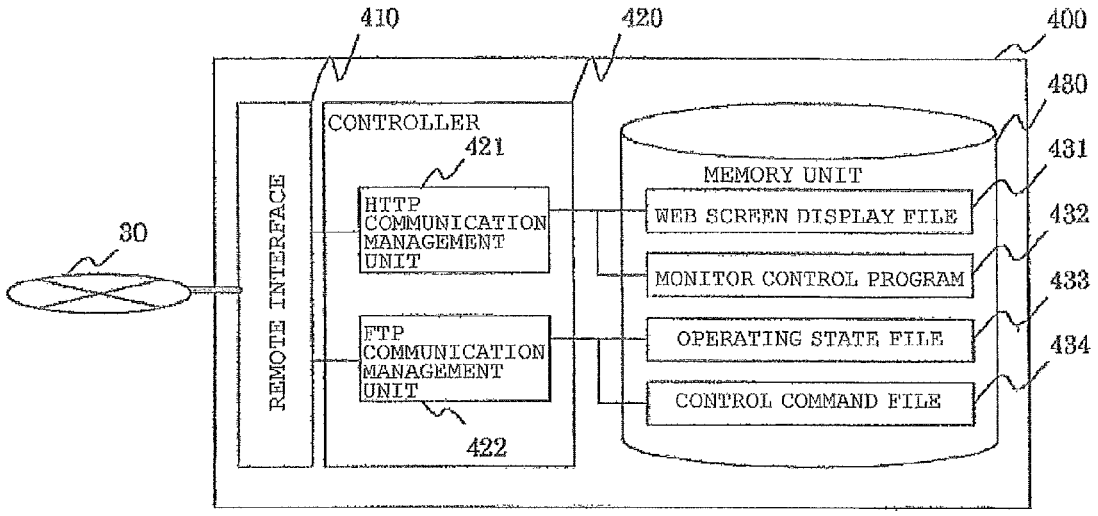
FIG. 5 is a function block diagram of a Web server 400.

FIG. 5 is a function block diagram of the Web server 400.

The Web server 400 is a server for publishing a home page on the Internet and includes a remote interface 410, a controller 420, and a memory unit 430.

The remote interface 410 communicates with the air conditioning management apparatus 200 and a remote monitor terminal 500 using HTTP (Hyper Text Transfer Protocol) and FTP (File Transfer Protocol).

The controller 420 controls communication which uses HTTP and FTP.

The memory unit 430 stores respective data to be described later.

The controller 420 includes an HTTP communication management unit 421 and an FTP communication management unit 422.

The HTTP communication management unit 421 transmits a Web screen display file 431 and a monitor control program 423 to be described later to the remote monitor terminal 500 through the remote interface 410.

The FTP communication management unit 422 transmits and receives an operating state file 433 and a control command file 434 to be described later between the air conditioning management apparatus 200 and the remote monitor terminal 500 through the remote interface 410.

The memory unit 430 stores the Web screen display file 431, a monitor control program 432, the operating state file 433, and the control command file 434.

The Web screen display file 431 is respective data constituting a Web page such as various HTML files, an image file, and sound data displayed on a Web browser included in the remote monitor terminal 500.

The monitor control program 432 is an application which is executed on the Web browser included in the remote monitor terminal 500 and used by the user to monitor and control the air conditioning equipment 100.

The operating state file 433 is a data file for recording the contents of the operating state file transmitted to the Web server 400 by the air conditioning management apparatus 200 using FTP.

The control command file 434 is a data file for recording the contents of the control command file transmitted to the Web server 400 by the remote monitor terminal 500 using FTP.

An example of a specific folder arrangement in the memory unit 430 will be explained by FIG. 8 to be described later.

The controller 420 and the respective components included in the controller 420 can be composed of hardware such as circuit devices for realizing their functions or can be also composed of arithmetic operation devices such as microcomputers and CPUs and software for prescribing the operations of the same.

The memory unit 430 can be composed of a memory device such as a HDD and a flash ROM.

Figure 6:
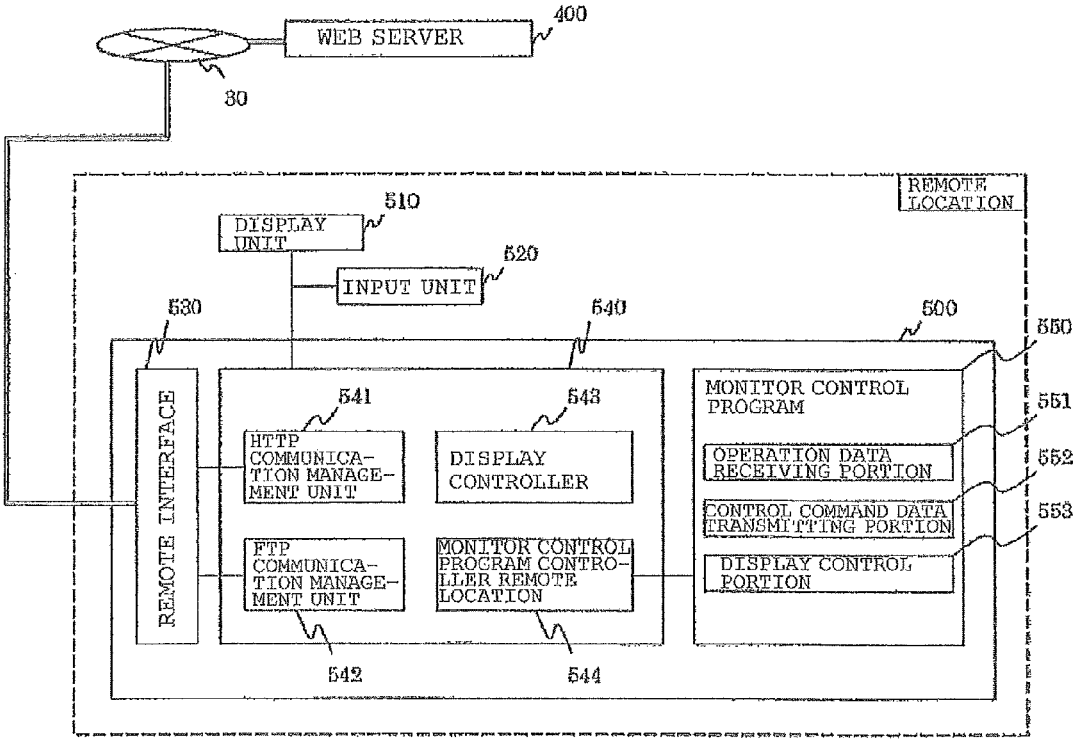
FIG. 6 is a function block diagram of the remote monitor terminal 500.

FIG. 6 is a function block diagram of the air conditioning equipment 500.

The remote monitor terminal 500 is a terminal through which the user is connected to the Web server 400 using the Web browser and monitors and controls the air conditioning equipment 100.

The remote monitor terminal 500 can be composed of a general purpose personal computer by which the Web browser is operated.

The remote monitor terminal 500 includes a display unit 510, an input unit 520, a remote interface 530, a controller 540, and a monitor control program 550.

The display unit 510 displays a screen which is created by the Web browser executed by the controller 540 to monitor and control the air conditioning equipment 100.

The input unit 520 is a unit for the user to switch the contents of the air conditioning equipment 100 to be monitored and to input control contents.

The remote interface 530 is a communication interface for permitting communication with the Web server 400 using HTTP and FTP.

The controller 540 controls the communication which uses HTTP and FTP. The controller 540 executes the Web browser and causes the display unit 510 to display the screen for monitoring and controlling the air conditioning equipment 100. Further, the controller 540 executes the monitor control program 550 on the Web browser.

The monitor control program 550 is composed of programs, for example, Java (registered trademark) Applet, Flash, and the like executed on the Web browser and creates a screen for monitoring and controlling the air conditioning equipment 100 on the Web browser, which will be described in detail later.

The controller 540 includes an HTTP communication management unit 541, an FTP communication management unit 542, a display controller 543, and a monitor control program controller 544.

The HTTP communication management unit 541 obtains the Web screen display file 431 and the monitor control program 423 from (the Web server 400 through the remote interface 530. The controller 540 develops the obtained monitor control program 423 an a memory and executes the monitor control program 423 on the Web browser as the monitor control program 550.

The FTP communication management unit 542 receives the operating state file 433 from the Web server 400 through the remote interface 410 and transmits the control command file 434 to the Web server 400.

The display controller 543 controls screen display processes of the Web browser and the monitor control program 550.

The monitor control program controller 544 controls a start, an operation, a finish management, and the like of the monitor control program 550.

The monitor control program 550 is a program executed on the Web browser and includes an operation data receiving portion 551, a control command data transmitting portion 552, and a display control portion 553. These function portions are arranged as one module of a program executed on the Web browser.

The operation data receiving portion 551 receives the operating state file showing the operating state of the air conditioning equipment 100 from the Web server 400 and analyzes the operating state file.

The control command data transmitting portion 552 transmits the control command file, on which a control command to the air conditioning equipment 100 is described, to the Web server 400.

The display control portion 553 executes a screen display process of the operating state file and the like.

The controller 540 and the respective components included in the controller 540 can be composed of hardware such as circuit devices for realizing the functions of the controller 250 and the respective components or can be also composed of arithmetic operation devices such as microcomputers and CPUs and software for prescribing the operations of the arithmetic operation devices.

The detailed arrangements of the respective equipment constituting the air conditioning management system have been explained as described above.

Next, operations of the respective equipment when the air conditioning equipment 100 is remotely monitored and controlled will be explained.

Figure 7:
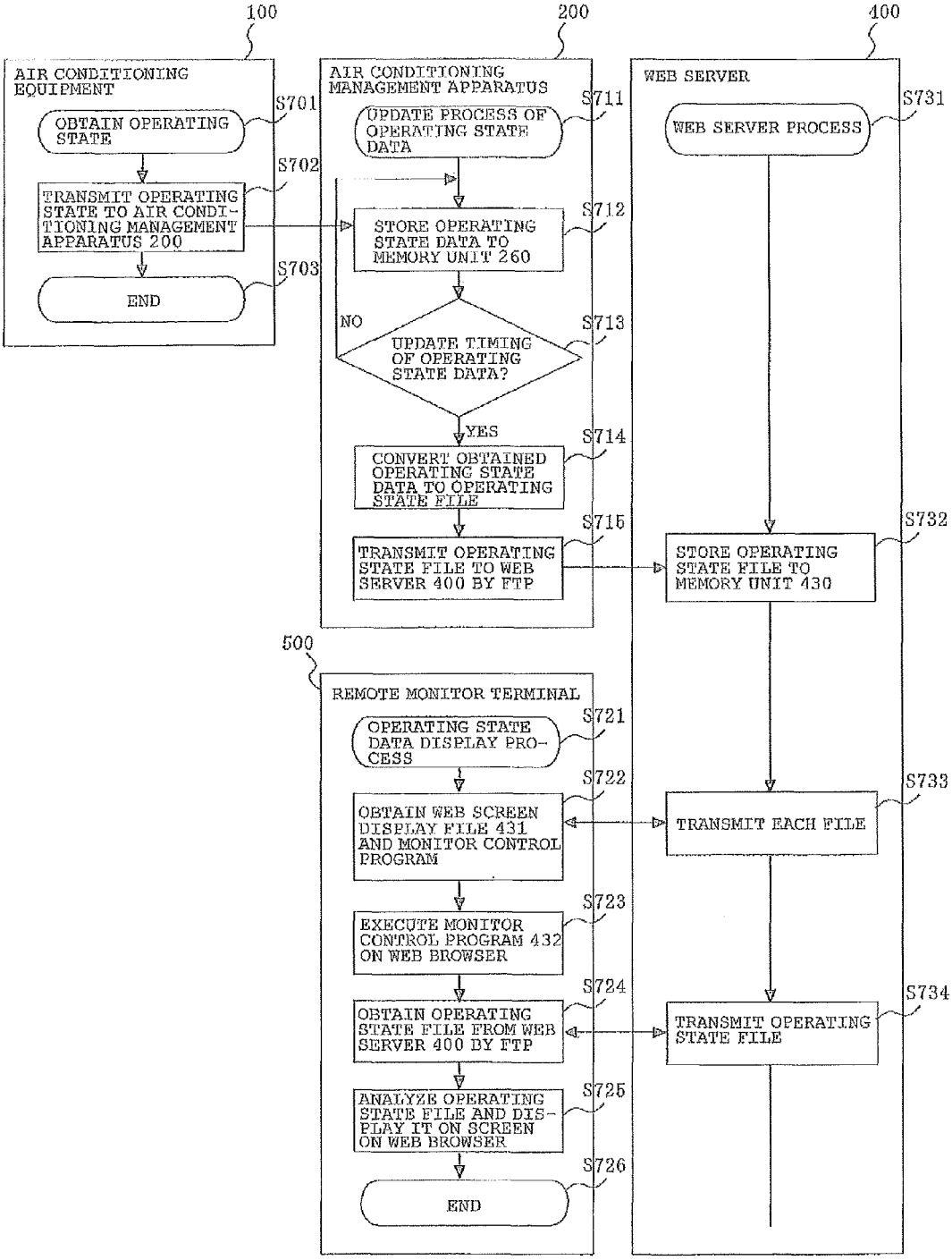
FIG. 7 is a view explaining an operation procedure of respective equipment to monitor operating states of the air conditioning equipment 100 from the remote monitor terminal 500.

FIG. 7 is a view explaining an operation procedure of the respective equipment to monitor operating states of the air conditioning equipment 100 from the remote monitor terminal 500. Respective steps of FIG. 7 will be explained below.

(S701)

The controller 110 of the air conditioning equipment 100 obtains the operating state based on a result of detection of the sensor 120 and the like when the operating state of the air conditioning equipment 100 changes or at timing such as a predetermined time interval and stores the operating state data 131 to the memory unit 130.

(S702)

The controller 110 transmits the operating state data 131 to the air conditioning management apparatus 200 through the communication management unit 140 at timing at which the operating state data 131 is created, timing at which the controller 110 receives a request from the air conditioning management apparatus 200, and the like.

(S703)

The process of the air conditioning equipment 100 is finished by the above steps.

(S711)

The controller 250 of the air conditioning management apparatus 200 starts an update process of the operating state data 261.

(S712)

The facility equipment communication management unit 251 receives the operating state data transmitted by the air conditioning equipment 100 at step S702 and stores the operating state data to the memory unit 260 as the operating state data 261.

(S713)

The controller 250 obtains a value set to the data update setting 263 and determines whether or not the value shows timing at which the operating state data 261 is transmitted to the Web server 400 and updated.

When the value shows the timing at which the operating state data 261 is updated, the process goes to step S714, whereas when the value does not show the timing, the process returns to step S712.

(S714)

The operation data transmission unit 255 converts the operating state data 261 to a file format which will be explained in FIG. 9 described below.

(S715)

The operation data transmission unit 255 obtains a value set to the Web server setting 262 and obtains the IP address and the like of the Web server 400. Next, the operation data transmission unit 255 transmits the file converted at step S714 to the Web server 400 through the FTP communication management unit 254 and the remote interface 240 using FTP.

(S721)

The user of the remote monitor terminal 500 instructs to start the Web browser by operating the input unit 520. The controller 540 starts the Web browser and causes the display unit 510 to display a screen of the Web browser.

Next, the user operates the input unit 520 and inputs URL (Uniform Resource Locator) of a Web page published by the Web server 400 to a URL column of the Web browser.

(S722)

The HTTP communication management unit 541 issues a Web page acquisition request of HTTP to the URL input by the user at step S721 through the remote interface 530.

The HTTP communication management unit 541 receives the Web screen display file 431 and the monitor control program 432 which constitute the Web page from the Web server 400.

(S723)

The display controller 543 causes the Web browser to display the Web screen display file 431 received from the Web server 400 at step S722 on a screen.

The monitor control program controller 544 develops the monitor control program 432 received from the Web server 400 at step S722 on the memory and executes the monitor control program 432 on the Web browser as the monitor control program 550.

Next, the monitor control program controller 544 causes the Web browser to display a screen for monitoring and controlling the air conditioning equipment 100 according to an operation prescribed by the display control portion 553 of the monitor control program 550.

(S724)

The monitor control program controller 544 obtains the operating state file 433 from the Web server 400 by FTP through the FTP communication management unit 542 and the remote interface 530 according to an operation prescribed by the operation data receiving portion 551 of the monitor control program 550.

(S725)

The monitor control program controller 544 analyzes the operating state file 433 received at step S724 according to the operation prescribed by the operation data receiving portion 551 of the monitor control program 550.

Next, the monitor control program controller 544 causes the Web browser to display the operating state according to an operation prescribed by the display control portion 553.

(S726)

The screen display process of the operating state is finished.

(S731)

The controller 420 of the Web server 400 waits for a request issued to the Web server 400 using HTTP and FTP.

(S732)

The FTP communication management unit 422 receives the operating state file, which is transmitted by the air conditioning management apparatus 200, by FTP through the remote interface 410.

(S733)

The HTTP communication management unit 421 transmits the Web screen display file 431 to the remote monitor terminal 500 through the remote interface 410.

(S734)

The FTP communication management unit 422 transmits the operating state file 433 to the remote monitor terminal 500 through the remote interface 410.

Figures 8, 9:
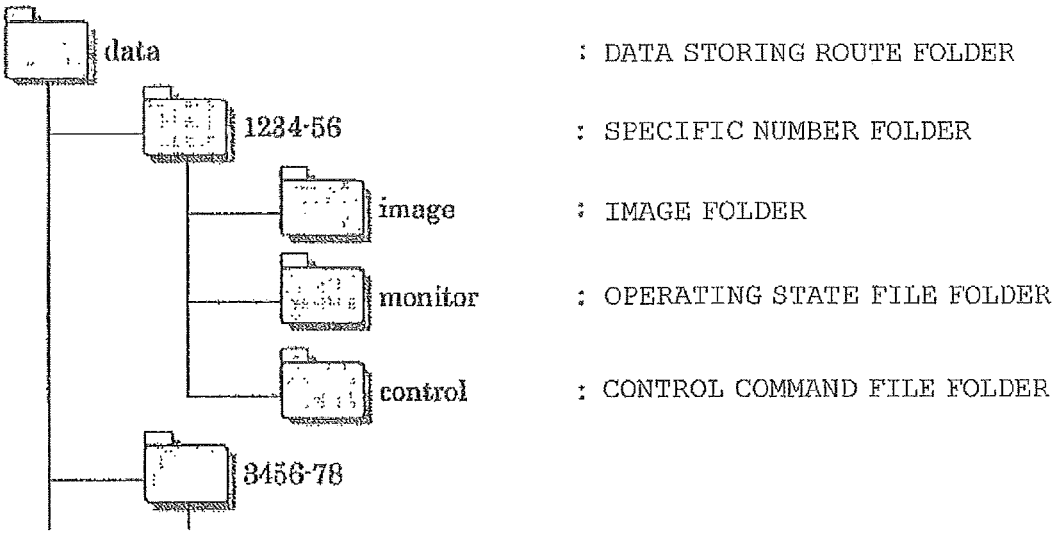
FIG. 8 is a view showing an arrangement example of folders in a memory unit 430 of the Web server 400.
FIG. 9 is a view showing an arrangement example of an operating state file 433.

FIG. 8 is a view showing an arrangement example of folders in the memory unit 430 of the Web server 400.

A data storage route folder is a highest-order folder for storing the respective data files under the control the route folder.

The data storage route folder is classified by a specific number folder to which the same name as the specific number of the air conditioning management apparatus 200 is added.

The specific number folder corresponds to the air conditioning management apparatus 200 corresponding to the specific number and stores an HTML file which constitutes a Web page for instructing to monitor and control the air conditioning equipment 100. The HTML file constitutes a part of the Web screen display file 431.

Further, the specific number folder includes an image folder, an operating state file folder, and a control command file folder.

The image folder stores an image file, which constitutes the Web page for instructing the air conditioning management apparatus 200 to monitor and control the air conditioning equipment 100, and other multi-media file and the like.

The operating state file folder stores the operating state file 433 corresponding to the air conditioning equipment 100 monitored by the air conditioning management apparatus 200.

The control command file folder stores the control command file 434 corresponding to the air conditioning equipment 100 monitored by the air conditioning management apparatus 200.

FIG. 9 is a view showing an arrangement example of the operating state file 433.

The operating state file 433 is described using a CSV (Comma Separated Value) format. A first row shows names of respective columns, and second and subsequent rows are data rows showing the operating states of the air conditioning equipment 100.

In the example of FIG. 9, a first column records the address of the air conditioning equipment 100 monitored by the air conditioning management apparatus 200, and second, third, fourth, fifth, and sixth columns record present values showing the operating states of the air conditioning equipment 100, that is, the second column records ON/OFF of power supply, the third column records an operation mode, the fourth column records a set temperature, the fifth column records a suction air temperature, and the sixth column records a fan speed.

Although the example of FIG. 9 shows that the present values of the operating states of the air conditioning equipment 100 are obtained, the values obtained by the sensor 120 may be recorded to the operating state file 433 or operation data such as an abnormal state may be obtained and recorded to the operating state file 433.

Further, the file format is not limited to the CSV format and may be arranged as a file format using a space separation and other separation character and as a binary format in which only data are recorded without a separation character, and further may be a file created by compressing data.

The operation procedure of the respective equipment to monitor the operating states of the air conditioning equipment 100 from the remote monitor terminal 500 has been explained above. Next, an operation procedure of the respective equipment for controlling an operation of the air conditioning equipment 100 from the remote monitor terminal 500 will be explained.

Figure 10:
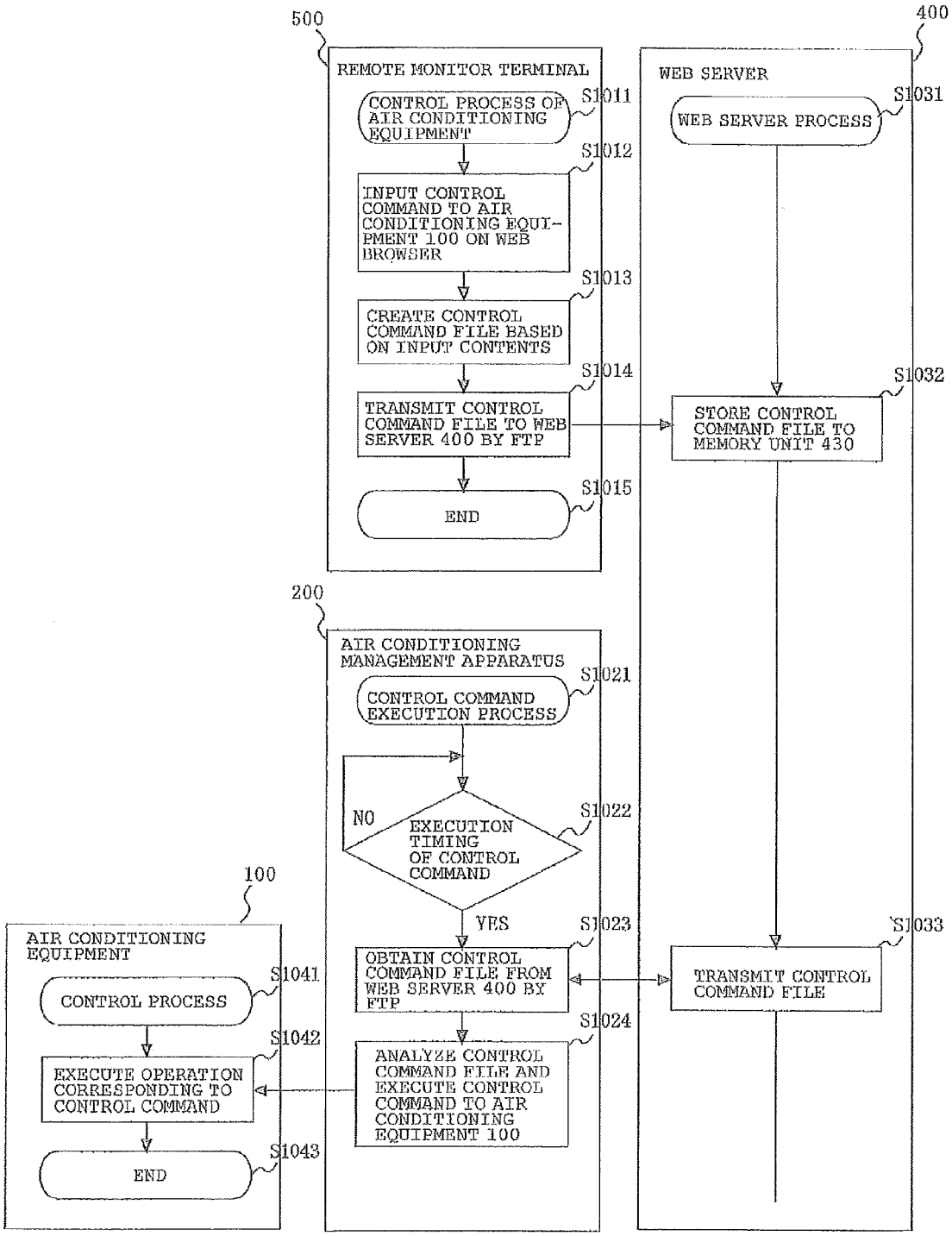
FIG. 10 is a view explaining an operation procedure of the respective equipment to control an operation of the air conditioning equipment 100 from the remote monitor terminal 500.

FIG. 10 is a view explaining the operation procedure of the respective equipment to control the operation of the air conditioning equipment 100 from the remote monitor terminal 500. Respective steps of FIG. 10 will be explained below.

(S1011)

A user of the remote monitor terminal 500 operates the input unit 520 and causes the Web browser to display a control screen of the air conditioning equipment 100.

(S1012)

The user operates the input unit 520 and inputs a control command to the air conditioning equipment 100 on a screen of the monitor control program executed on the Web browser. The control command input here is an operation command, for example, "turn OFF a power supply."

(S1013)

The monitor control program controller 544 of the remote monitor terminal 500 creates a control command file of a format explained in FIG. 11 to be described later based on the contents of the control command input by the user at step S1012.

(S1014)

The monitor control program controller 544 transmits the control command file created at step S1013 to the Web server 400 by FTP through the FTP communication management unit 542 and the remote interface 530 according to an operation prescribed by the control command data transmitting portion 552.

(S1015)

The operation of the remote monitor terminal 500 is finished.

(S1021)

The controller 250 of the air conditioning management apparatus 200 starts an execution process of the control command.

(S1022)

The controller 250 goes to a step for executing the following control command at, for example, a predetermined time interval and the like. When timing at which the control command is executed is reached, the controller 250 goes to next step S1023, whereas when the timing is not reached, the controller 250 executes step S1023 again after it waits for, for example, a predetermined time.

(S1023)

The control command file receiving unit 256 receives the control command file 434 from the Web server 400 by FTP through the FTP communication management unit 254 and the remote interface 240.

(S1024)

The control command file receiving unit 256 analyzes the received control command file 434.

The control command file receiving unit 256 executes the control command to the air conditioning equipment 100 instructed in the control command file 434 through the facility equipment communication management unit 251 and the facility equipment interface 230.

(S1031)

The controller 420 of the Web server 400 waits for a request issued to the Web server 400 using HTTP and FTP.

(S1032)

The FTP communication management unit 422 receives the control command file transmitted by the remote monitor terminal 500 by FTP through the remote interface 410.

(S1033)

The FTP communication management unit 422 transmits the control command file 434 to the air conditioning management apparatus 200 through the remote interface 410.

(S1041)

The controller 110 of the air conditioning equipment 100 starts a control process.

(S1042)

The controller 110 receives a control command issued by the air conditioning management apparatus 200 through the communication management unit 140 and executes a control operation of the control command.

(S1043)

The control process is finished.

Figures 11, 12:
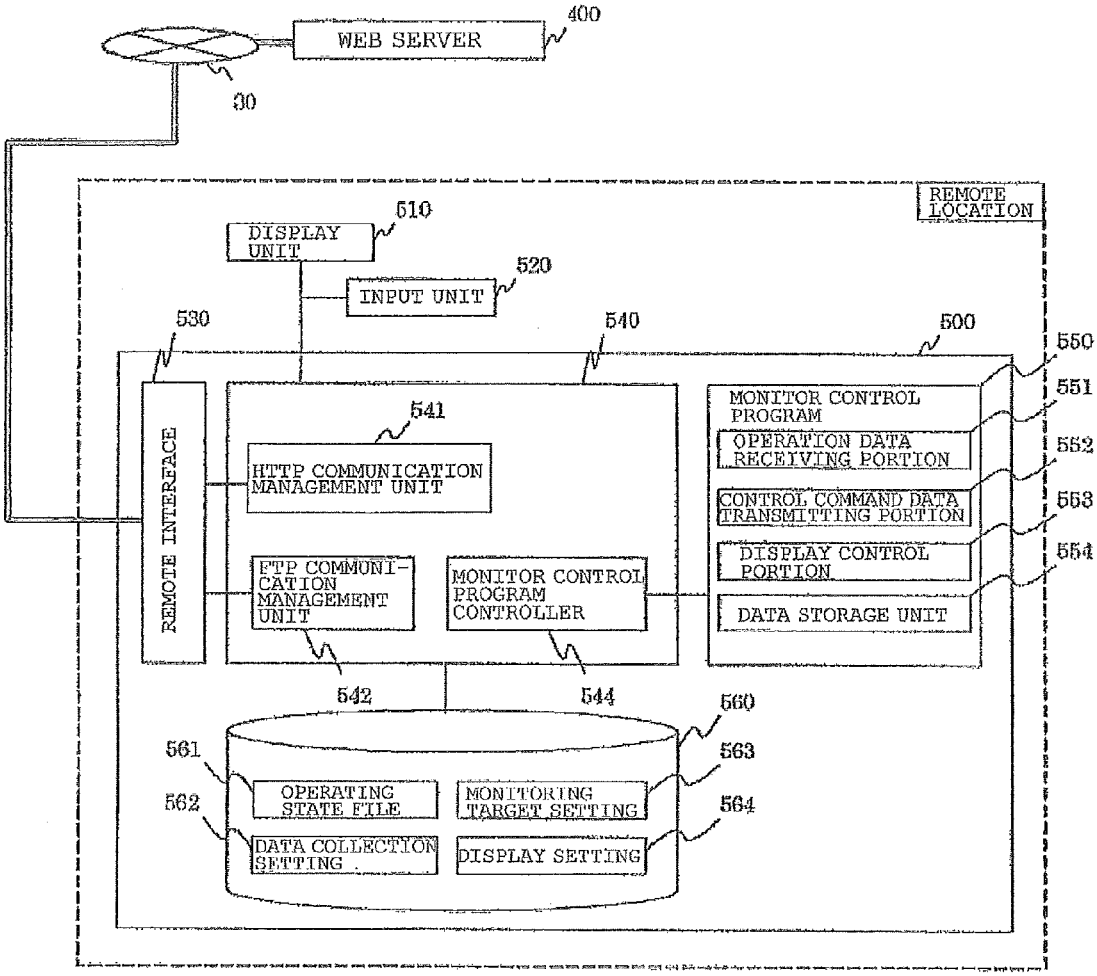
FIG. 11 is a view showing an arrangement example of a control command file 434.
FIG. 12 is a function block diagram of a remote monitor terminal 500 according to an embodiment 4.

FIG. 11 is a view showing an arrangement example of the operating state file 434.

Although an example for setting an operation and a schedule is shown in the example, control data such as an energy saving control and a fixed time communication can be also used.

The control command file 434 is a text file of a CSV format. Respective columns are described in a format of "control target item=control value."

The file format is not limited to the CSV format and may be arranged as a file format using a space separation and other separation character and as a binary format in which only data are recorded without a separation character, and further may be a file created by compressing data.

The operation procedure of the respective equipment for controlling the operation of the air conditioning equipment 100 from the remote monitor terminal 500 has been explained above.

When the plurality of pieces of air conditioning equipment 100 are monitored and controlled from the remote monitor terminal 500, methods (1) to (2) described below may be used to permit the user to select control target air conditioning equipment 100 on the screen of the Web browser.

(1) An air conditioning management apparatus connection. setting file, which describes to which air conditioning management apparatus 200 the user can be connected, is stored to the memory unit 430 of the Web server 400.

The controller 540 of the remote monitor terminal 500 obtains the air conditioning management apparatus connection setting file, finds to which air conditioning management apparatus 200 the user can be connected through the Web server 400 by analyzing the contents of the file, and permits the user to select the air conditioning management apparatus 200 to which the user can be connected.

The air conditioning management apparatus connection setting file may be manually registered to the Web server 400 after the air conditioning management apparatus 200 is installed or may be automatically registered from the air conditioning management apparatus 200 to the Web server 400.

(2) When the operating state file 433 is directly browsed on the Web browser without using the monitor control program 550, a link to the operating state file folder of FIG. 8 is described to the HTML file constituting a screen through which a monitor and a control are executed.

When the user clicks the link on the Web browser, the user can browse the operating state file 433 stored to a relevant operating state file folder.

As described above, in the air conditioning management system according to the embodiment 2, since it is not necessary to directly access the air conditioning management apparatus 200 from the remote monitor terminal 500, a global (fixed) IP address need not be allocated to the air conditioning management apparatus 200. Accordingly, a cost necessary to obtain the global IP address can be reduced.

In the air conditioning management system according to the embodiment 2, since the plurality of air conditioning management apparatuses 200 can be used by a single Internet connection contract, a running cost can be reduced. Since the air conditioning management apparatus 200 cannot be directly accessed from the Internet 30, the air conditioning management system is safe in network security because the system does not receive a mischief and an attack from a malicious user on the Internet.

Further, in the air conditioning management system according to the embodiment 2, the operating state file is transmitted from the air conditioning management apparatus 200 installed in the LAN 20 to the Web server 400.

In the conventional technology, the air conditioning equipment 100 cannot be remotely monitored and controlled because the air conditioning management apparatus 200 installed in the LAN 20 cannot be accessed from the Internet 30. however, the arrangement described above permits the air conditioning equipment 100 to be monitored and controlled from the remote monitor terminal 500 through the Internet 30.

Further, in the air conditioning management system according to the embodiment 2, since monitor screens of the plurality of air conditioning management apparatuses 200 installed in a building can be switched by the link of the same Web page and URL need not be switched, a time necessary to a monitor operation can be reduced.

Embodiment 3

In the embodiments 1 to 2, no particular information leakage countermeasure is employed to a communication between the air conditioning management apparatus 200 and the Web server 400 and a communication between the Web server 400 and the remote monitor terminal 500. This is also the same as to the operating state file 433 and the control command file 434.

An embodiment 3 of the invention will explain an example for employing an information leakage countermeasure by encrypting the data files and the communication paths described above. Since the arrangements of respective equipment and a network are the same as those of the embodiments 1 and 2, explanation thereof is omitted.

Examples (1) to (3) described below are considered as methods of preventing an information leakage.

(1) Authentication of User (1.1) Authentication through Web Server 400

An authentication information file, in which authentication information for making use of an air conditioning management apparatus 200 is described, is stored to a memory unit 260 of the air conditioning management apparatus 200.

A user of a remote monitor terminal 500 inputs login information (a user name, a password, and the like) using an input unit 520.

When the remote monitor terminal 500 accesses a Web server 400, the remote monitor terminal 500 transmits the login information to the Web server 400. The Web server 400 stores the login information to a memory unit 430 as a login information file.

When a controller 250 of the air conditioning management apparatus 200 communicates with the Web server 400, the controller 250 obtains the login information file and compares the contents of the login information file with the contents of the authentication information file stored to the memory unit 260.

Only after the controller 250 confirms that both the contents agree with one another, the controller 250 transmits an operating state file to the Web server 400 and obtains a control command file 434 from the Web server 400.

(1.2) Store that Authentication has been Completed to Web Server 400

In the procedure described in (1.1), after the controller 250 of the air conditioning management apparatus 200 confirms that the contents of the login information file agree with the contents of the authentication information file, the controller 250 transmits the operating state file to the Web server 400 as well as transmits a file to which it is recorded that authentication has been completed.

The remote monitor terminal 500 accesses the Web server 400 and only when the file, in which it is recorded that authentication has been completed, is stored in the Web server 400, the remote monitor terminal 500 obtains the operating state file from the Web server 400.

(2) Encryption of File (2.1) Encryption of Operating State File 433

When the controller 250 of the air conditioning management apparatus 200 transmits the operating state file to the Web server 400, the controller 250 encrypts the operating state file using an encryption key created using a value specific to the air conditioning management apparatus 200, for example, a manufacturing number 264 and the like.

A controller 540 of the remote monitor terminal 500 previously obtains the encryption key and decrypts the operating state file 433 using the encryption key when the controller 540 obtains the operating state file 433 from the Web server 400.

(2.2) Encryption of Control Command File

The controller 540 of the remote monitor terminal 500 previously obtains the encryption key described above, and when the controller 540 transmits the control command file to the Web server 400, the controller 540 encrypts the control command file using the encryption key.

When the controller 250 of the air conditioning management apparatus 200 obtains the control command file 434 from the Web server 400, the controller 250 decrypts the control command file 434 using an encryption key held by the controller 250.

(2.3) Encryption Using Login Information

When the controller 250 of the air conditioning management apparatus 200 transmits the operating state file to the Web server 400, the controller 250 encrypts the operating state file using the authentication information explained in (1) described above.

When the controller 540 of the remote monitor terminal 500 obtains the operating state file 433 from the Web server 400, the controller 540 creates a decryption key using the login information and decrypts the operating state file 433.

When the authentication information held by the air conditioning management apparatus 200 agrees with the login information input to the remote monitor terminal 500, the encryption key is caused to correspond to the decryption key. Accordingly, the controller 540 of the remote monitor terminal 500 can decrypt the operating state file 433.

As to transmission of the control command file 434, the control command file 434 can be also encrypted using the login information likewise.

(2.4) Acquisition of Decryption Key

When the controller 250 of the air conditioning management apparatus 200 transmits the file, in which it is recorded that authentication has been completed, to the Web server 400 in the procedure (1.2) described above, the decryption key of the operating state file may be included in the above file.

Further, when the controller 250 of the air conditioning management apparatus 200 transmits the file, in which it is recorded that authentication has been completed, to the Web server 400, the controller 250 may transmit the file after the file is encrypted using the login information input to the remote monitor terminal 500, and the like.

(2.5) Rule for Creating Decryption Key

When the decryption key of the operating state file is created, it may be taken into consideration to use a value obtained by adding, for example, date and time information, and the like to the login information file to create a unique decryption key.

With this operation, even if a decryption key created in the past is dishonestly obtained, safety is improved because the operating state file cannot be decrypted using the decryption key.

(3) Encryption of Communication Paths

A communication between the air conditioning management apparatus 200 and the Web server 400 and a communication between the Web server 400 and the remote monitor terminal 500 may be encrypted and authenticated using SSL (Secure Sockets Layer) and the like.

Further, the operating state file 433 and the control command file 434 may be encrypted based on certification data used in SSL.

Encryption and authentication processes are executed by controllers of the respective equipment.

The methods (1) to (3) explained in the embodiment 3 may be used in an arbitrary combination.

As described above, according to the air conditioning management system of the embodiment 3, the authentication and the encryption can prevent a leakage of the contents of the operating state file 433 and the control command file 434.

In particular, in a network arrangement in which the respective equipment communicate with each other through the Internet 30, since a packet passes through a large and indefinite number of communication equipment, the information leakage countermeasure of the embodiment 3 is effective.

Embodiment 4

Although the monitor control program 550 is explained in the embodiments 2 to 3 as a program executed on the Web browser, the arrangement of the monitor control program 550 is not limited thereto.

An embodiment 4 of the invention explains an example for arranging a monitor control program 550 as an ordinary application capable of storing data. Since the arrangements of respective equipment and a network other than the remote monitor terminal 500 are the same as those of the embodiments 1 and 3, explanation thereof is omitted.

FIG. 12 is a function block diagram of the remote monitor terminal 500 according to the embodiment 4.

In FIG. 12, the remote monitor terminal 500 newly includes a memory unit 560 in addition to the arrangement explained in FIG. 6 of the embodiment 2.

Further, the monitor control program 550 is arranged as an ordinary stand-alone application and newly includes a data storage unit 554 in addition to the arrangement explained in FIG. 6 of the embodiment 2. Since the functions of constitution units having the same names are the same as those explained in FIG. 6, explanation thereof is omitted.

Respective function units included in the monitor control program 550 are arranged as one module of the stand-alone application.

The data storage unit 554 stores respective data files to be described later to the memory unit 560.

The memory unit 560 stores an operating state file 561, a data collection setting 562, a monitor target setting 563, and a display setting unit 564.

The operating state file 561 stores an operating state file 433 obtained from a Web server 400 to the memory unit 560.

The data collection setting 562 is a data file in which items to be collected of operating states of air conditioning equipment 100 as a monitor target and a cycle of collection of the items are recorded. When the remote monitor terminal 500 performs a remote monitor, the remote monitor terminal 500 transmits the contents of the remote monitor to an air conditioning management apparatus 200.

With this operation, even if a type of the air conditioning equipment 100 is changed or a new type begins to be sold, it becomes unnecessary to update software of the air conditioning management apparatus 200 in order to update the items to be collected of the operating states and the cycle of collection of the items.

Accordingly, since a user need not to visit a location where the air conditioning management apparatus 200 is installed and to perform a version-up job to update the software of the apparatus 200, maintenance property can be improved.

The monitor target setting 563 is a data file in which set information as to which operating states of the air conditioning equipment 100 are to be collected is recorded. When a communication load becomes excessive by collecting the operating states of all the types of the air conditioning equipment 100, traffic can be suppressed by restricting the types of the equipment 100 to be monitored and describing the restricted types to the setting file.

Display setting 564 is a data file in which various settings as to a display method are recorded.

The memory unit 560 can be composed of a memory device such as a HDD and a flash ROM.

The embodiments 2 to 3 explain the example for issuing the control command from the remote monitor terminal 500 to the air conditioning equipment 100. An operation prescribed by a monitor control program 550 according to the embodiment 4 is the same as that explained in the embodiments 2 to 3 as a general rule.

In the embodiment 4, operations of respective equipment when it is instructed to periodically obtain the operating states of the air conditioning equipment 100 from the remote monitor terminal 500 to the air conditioning management apparatus 200 will be explained as one of operation examples.

Figure 13:
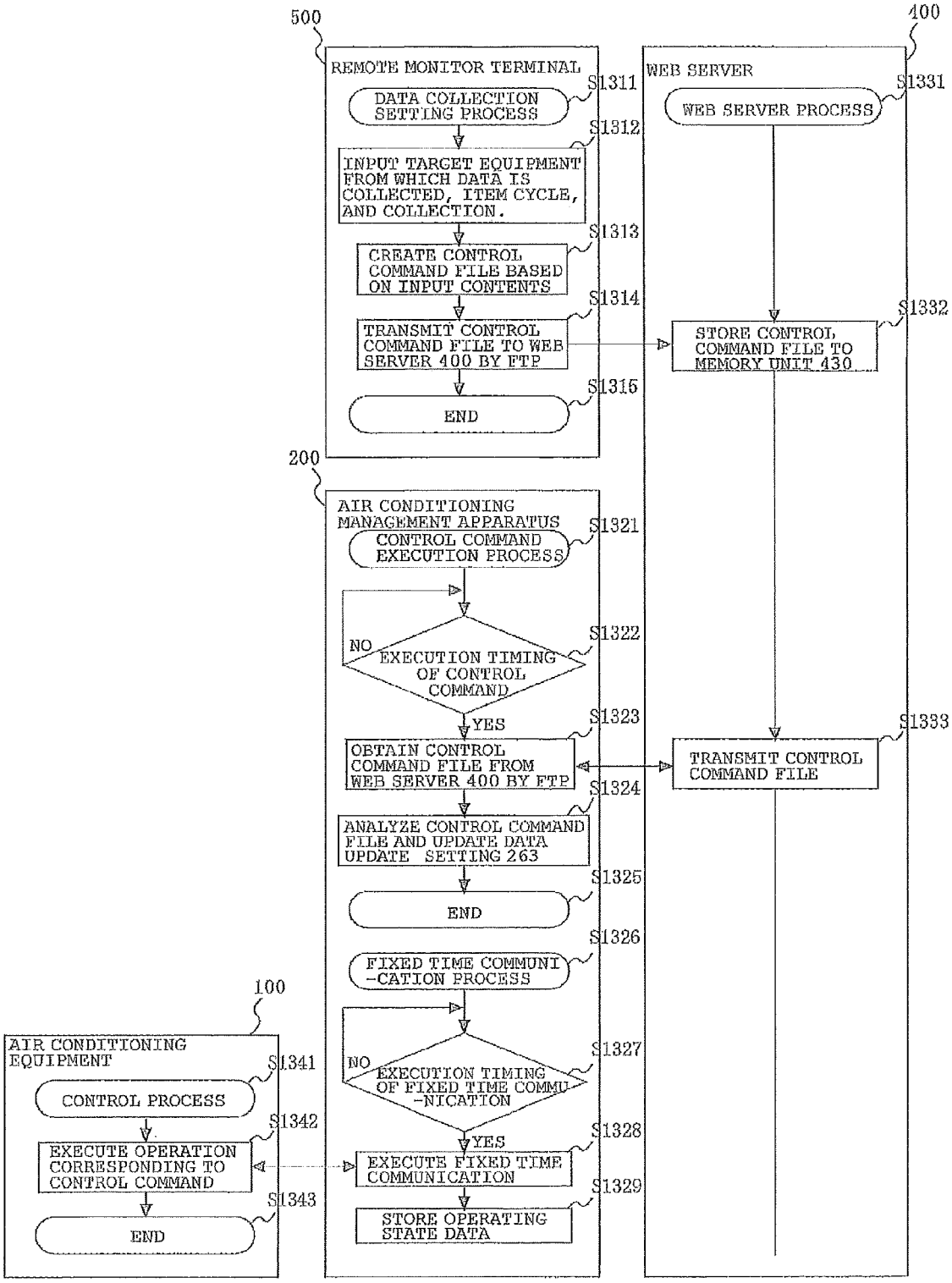
FIG. 13 is a view showing an operation procedure of respective equipment when it is instructed from the remote monitor terminal 500 to an air conditioning management apparatus 200 to periodically obtain operating states of air conditioning equipment 100.

FIG. 13 is a view showing an operation procedure of the respective equipment when it is instructed from the remote monitor terminal 500 to the air conditioning management apparatus 200 to periodically obtain the operating states of the air conditioning equipment 100. Respective steps of FIG. 13 will be explained below.

(S1311)

The user of the remote monitor terminal 500 operates the input unit 520 and instructs to open a screen for inputting an instruction to the air conditioning management apparatus 200 on the monitor control program 550.

A monitor control program controller 544 causes a display unit 510 to display the screen for inputting the instruction to the air conditioning management apparatus 200 according an operation prescribed by a display control portion 553.

(S1312)

The user operates the input unit 520 and inputs units for collecting the operating states, the items, the cycle of collection, a period of collection, and the like.

The monitor control program controller 544 stores the input contents to the memory unit 560 as the data collection setting 562 and the monitor target setting 563 according to an operation prescribed by the data storage unit 554.

(S1313) to (S1315)

Since steps S1313 to S1315 are the same as steps S1013 to S1015 of FIG. 10, explanation thereof is omitted.

(S1321) to (S1323)

Since steps S1321 to S1323 are the same as steps S1021 to S1023 of FIG. 10, explanation thereof is omitted.

(S1324)

A control command file receiving unit 256 of the air conditioning management apparatus 200 analyzes a received control command file 434. The control command file 434 has an instruction described thereto which instructs the air conditioning management apparatus 200 to periodically obtain the operating states of the air conditioning equipment 100.

A controller 250 updates the data update setting 263 based on the contents of the instruction.

(S1325)

The control command execution process is finished.

(S1326)

The controller 250 starts a fixed time communication process based on the contents set by a data update setting 263.

(S1327)

The controller 250 determines whether or not timing is reached at which a fixed time communication is performed based on the contents set by the data update setting 263. When the timing of the fixed time communication is reached, the process goes to step S1328, whereas when the timing of the fixed time communication is not reached, the process executes step S1328 again after it waits for a predetermined time.

(S1328)

The controller 250 executes a control command for obtaining the operating state data of the air conditioning equipment 100 through a facility equipment communication management unit 251 and a facility equipment interface 230.

(S1329)

The facility equipment communication management unit 251 receives the operating state data transmitted by the air conditioning equipment 100 and stores the operating state data to a memory unit 260 as operating state data 261.

(S1333) to (S1333)

Since steps S1331 to S1333 are the same as step S1031 to S1033 of FIG. 10, explanation thereof is omitted.

(S1341) to (S1343)

Since steps S1341 to S1343 are the same as steps S1041 to S1043 of FIG. 10, explanation thereof is omitted.

Figure 14:
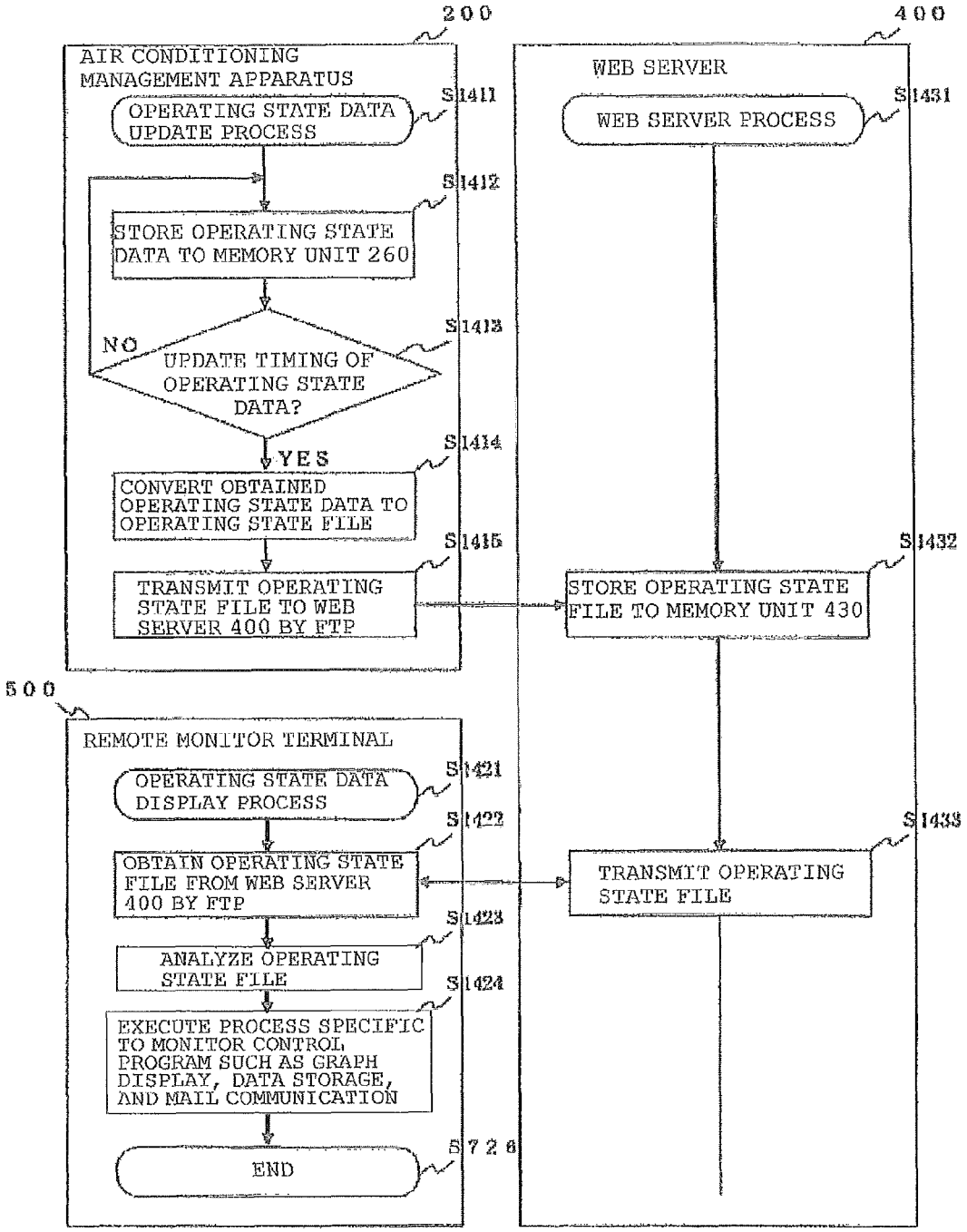
FIG. 14 is a view explaining an operation procedure of the respective equipment to monitor the operating states of the air conditioning equipment 100 from the remote monitor terminal 500.

FIG. 14 is a view explaining an operation procedure of the respective equipment to monitor the operating states of the air conditioning equipment 100 from the remote monitor terminal 500. Respective steps of FIG. 14 will be explained below.

(S1411) to (S1415)

Since steps S1411 to S1415 are the same as steps S711 to S715 of FIG. 7, explanation thereof is omitted.

(S1421)

The user of the remote monitor terminal 500 operates the input unit 520 and instructs to start the monitor control program 550. The monitor'control program controller 544 starts the monitor control program 550 and causes the display unit 510 to display a screen of the monitor control program 550.

Next, the user operates the input unit 520 and causes a screen for monitoring and controlling the air conditioning equipment 100 to be displayed on the monitor control program 550.

(S1422)

The monitor control program controller 544 obtains the operating state file 433 from the Web server 400 by FTP through an FTP communication management unit 542 and a remote interface 530 according to an operation prescribed by an operation data receiving portion 551 of the monitor control program 550.

(S1423)

The monitor control program controller 544 analyzes the operating state file 433 received at step S1422 according to the operation prescribed by the operation data receiving portion 551 of the monitor control program 550.

(S1424)

The monitor control program controller 544 executes operations specific to the monitor control program 550 such as an operation for displaying the contents of the operating state file 433 by a graph, an operation for accumulating the contents of the file 433 to the memory unit 560, and an operation for transmitting the contents of the file 433 by an electronic mail according to an operation prescribed by a display control portion 553 and the data storage unit 554.

Although it may be difficult to execute these operations on the Web browser, they can be easily executed by the standalone application.

(S1425)

The operation of the monitor control program 550 is finished.

Although the embodiment 4 explains that the remote monitor terminal 500 is arranged using a general purpose computer, a mobile phone, a PDA (Personal Digital Assistant), a mobile computer, and the like can be used in place of the general purpose computer.

As described above, according to an air conditioning management system of the embodiment 4, since operating state files can be transmitted and received between the remote monitor device 500 and the air conditioning management apparatus 200 which are installed in remote locations through the Web server 400, the periodically collected operating state files can be confirmed in the remote location without confirming them by visiting the remote place where the air conditioning management apparatus 200 is installed.

Further, since an installation space, a main body size, and the like of the remote monitor terminal 500 are not so restricted and further the remote monitor terminal 500 can be arranged using the general purpose computer, it can include a relatively large memory region.

Since the operating state file having a large capacity can be stored in the memory unit 560, it is possible to collect large-capacity operating state data such as pressure, temperature, the number of revolutions of a compressor, an amount of saved capability which cannot be collected conventionally because a memory size of the air conditioning management apparatus 200 is restricted.

Embodiment 5

The embodiments 1 to 4 have explained that the Web server 400 is connected to the Internet 30. However, a specialized knowledge is necessary to install the dedicated server. Further, a cost is necessary to operate and manage the server.

An embodiment 5 of the invention will explain an example for using a Web server, which can be ordinarily used free of charge as the Web server 400 explained in the embodiments 1 to 4. Since the arrangements of respective equipment and a network are the same as those of the embodiments 1 and 4, explanation thereof is omitted.

In the embodiment 5, a designer of an air conditioning management system makes a contract with an Internet provider to prepare an Internet connection environment.

Next, the designer makes various settings (a server name of a connecting destination, a user ID, a password, and the like) to an Internet connection router 600 to connect to the Internet so that an air conditioning management apparatus 200 connected to a LAN 20 can communicates with a server on the Internet 30.

Next, the designer of the air conditioning management system sets a server name or an IP address of a Web server 400 provided by the Internet provider to a Web server setting 262 in a memory unit 260 as a home page service.

Further, the designer sets a time interval, at which operating state data is updated to the Web server 400, and a time interval, at which control contents are read from the Web server 400, to a data update setting 263.

The set contents may be input from an input unit 220 of the air conditioning management apparatus 200 or may be set from a local monitor terminal 300 and a remote monitor terminal 500.

When the Internet provider is selected, it must be taken into consideration whether or not a Web server being provided has an HTTP communication function, an FTP communication function, and a file storage region as explained in FIG. 5.

As described above, according to the air conditioning management system of the embodiment 5, since operation data is transmitted and received between the remote monitor terminal 500 and the air conditioning management apparatus 200, which are installed in remote locations, through the Web server 400 provided by the Internet provider, a Web server need not be installed on the Internet.

With this arrangement, since a load such as start-up and periodical maintenance (including security countermeasure) of a Web server and data back-up, which are conventionally performed, is eliminated, even a user having no specialized knowledge as to the Web server can easily construct the air conditioning management system.

Further, according to the air conditioning management system of the embodiment 5, since a Web server function (home page service) is ordinarily provided by the Internet provider as a free of charge service when the connection to the Internet is contracted, an introduction cost necessary to construct the air conditioning management system and a running cost can be reduced.

Embodiment 6

An embodiment 6 of the invention will explain a modification of the embodiments 1 to 5. Since the arrangement of the embodiment 6 is the same as those of the embodiments 1 to 5 except the matters explained in the embodiment 6, a different point will be mainly explained.

(1) Communication Protocol

It has been explained that the operating state file and the control command file are transmitted and received using FTP, a communication protocol other than FTP may be used. For example, the following methods can be considered.

(1.1) A program such as CGI (Common Gateway Interface) and Servlet for accepting transmission of a file is disposed to the Web server 400.

When the air conditioning management apparatus 200 and the remote monitor terminal 500 transmits a file to the Web server 400, the apparatus 200 and the terminal 500 issue a POST request of HTTP to the program and transmit the contents of a target file to the program.

When the air conditioning management apparatus 200 and the remote monitor terminal 500 obtain a file from the Web server 400, it is sufficient for the apparatus 200 and the terminal 500 to place the file to a folder under an HTTP server and to issue a GET request of HTTP to the file.

Otherwise, there can be also considered such a method that the Web server 400 receives predetermined login information from the air conditioning management apparatus 200 and the remote monitor terminal 500 through the program such as CGI and transmits a target file through CGI as long as the login information is regular login information.

(1.2) The Web server 400 waits for a request from the air conditioning management apparatus 200 and the remote monitor terminal 500 by opening an appropriate TCP port.

When the air conditioning management apparatus 200 and the remote monitor terminal 500 transmits and receives a file between them and the Web server 400, the apparatus 200 and the terminal 500 issue a file transmission/reception request to the TCP port.

(2) Proxy Server

In FIG. 1 explained in the embodiment 1, the network is connected to the Internet 30 from the LAN 20 to which the air conditioning management apparatus 200 is connected through the Internet connection router 600.

However, a proxy server, which is ordinarily used in a connection from LAN to the Internet 30, may be installed in, for example, the building of FIG. 1 and a remote location, and when the air conditioning management apparatus 200 and the remote monitor terminal 500 are connected to the Web server 400, the apparatus 200 and the terminal 500 may be connected to the Web server 400 through the proxy server.

(3) Access Timing to Web Server 400

Although it has been explained in the embodiment 1 that the air conditioning management apparatus 200 accesses the Web server 400 at the timing set to the data update setting 263, the apparatus 200 may be operated at fixed timing without using the data update setting 263.

Further, the Web server 400 may be accessed at timing when a specific event occurs such as when operating state data is received from the air conditioning equipment 100.

(4) A communication line specific to the air conditioning equipment 100 or a general purpose communication line such as LAN may be used as the dedicated communication line 10 for connecting the air conditioning management apparatus 200 and the air conditioning equipment 100.

(5) Although the local monitor terminal 300 is included in the system arrangement for performing a monitor in a building, the terminal 300 need not be necessarily installed in a system for performing only a monitor and a control from a remote location.

(6) The embodiments described above have explained the example for monitoring and controlling the air conditioning equipment 100. However, a target to be monitored and controlled is not limited to the air conditioning equipment 100, and facility equipment, for example, illumination equipment and the like the operation of which can be controlled by the air conditioning management apparatus 200 can be also monitored and controlled from the remote monitor terminal 500 by the same method.

The invention claimed is:

1. An air conditioning management apparatus for controlling an operation of air conditioning equipment, comprising:

a facility equipment interface connected to the air conditioning equipment;

a remote interface connected to a network;

a facility equipment communication management unit for communicating with the air conditioning equipment through the facility equipment interface and obtaining operating state data showing an operating state of the air conditioning equipment; and a remote communication management unit for converting the operating state data representing each operating state to an operating state file at a timing at which the operating state data is to be transmitted to a predetermined destination on the network and updated, encrypting the operating state, and transmitting the encrypted operating state file to the predetermined destination on the network through the remote interface.

2. The air conditioning management apparatus of claim 1, wherein the remote communication management unit requests the destination through the remote interface to transmit a control command file in which a control command to the air conditioning equipment is described, and when receiving the control command file, the remote communication management unit executes the control command described in the control command file and controls the air conditioning equipment.

3. The air conditioning management apparatus of claim 2, wherein the remote communication management unit requests the destination to transmit the control command file using FTP.

4. The air conditioning management apparatus of claim 1, wherein the remote communication management unit transmits the operating state file to the destination using FTP.

5. An air conditioning management system comprising:

the air conditioning management apparatus of claim 1;

a server having memory means for storing the operating state file; and a remote monitor terminal for remotely monitoring the air conditioning equipment through the server, wherein:

the air conditioning management apparatus is connected to the server through the remote interface;

the remote communication management unit transmits the operating state file to the server; and the remote monitor terminal comprises a screen display unit for displaying information on a display, requests the server to transmit the operating state file, receives the operating state file, and displays the operating state file using the screen display unit.

6. The air conditioning management system of claim 5, wherein:

the remote monitor terminal transmits a control command file in which a control command to the air conditioning equipment is described to the server; and the remote communication management unit requests the server through the remote interface to transmit the control command file.

7. The air conditioning management system of claim 6, wherein the remote monitor terminal encrypts the control command file using an encryption key calculated based on a value specific to the air conditioning management apparatus and transmits the control command file to the server.

8. The air conditioning management system of claim 6, wherein the remote monitor terminal transmits login information for authentication to the server, encrypts the control command file using the login information, and transmits the control command file to the server;

the air conditioning management apparatus comprises memory means in which predetermined authentication information is stored; and when the remote communication management unit receives the control command file from the server, the remote communication management unit decrypts the control command file using the authentication information.

9. The air conditioning management system of claim 5, wherein:

the remote monitor terminal transmits login information for authentication to the server;

the air conditioning management apparatus comprises memory means in which predetermined authentication information is stored; and the remote communication management unit obtains login information transmitted by the remote monitor terminal through the server and communicate with the server only when the login information agrees with the authentication information.

10. The air conditioning management system of claim 6, wherein the remote monitor terminal comprises a monitor control program for transmitting the control command file by communicating with the server.

11. The air conditioning management system of claim 5, wherein the remote monitor terminal comprises a monitor control program for obtaining the operating state file by communicating with the server; and the monitor control program obtains the operating state file from the server, analyzes the operating state file, and displays an operating state of the air conditioning equipment using the screen display unit.

12. The air conditioning management system of claim 10, wherein the monitor control program is configured as a program executed on a Web browser.

13. The air conditioning management system of claim 5, wherein the server is a Web server provided by an Internet provider.

14. The air conditioning management apparatus of claim 2, wherein the remote communication management unit transmits the operating state file to the destination using FTP.

15. The air conditioning management apparatus of claim 3, wherein the remote communication management unit transmits the operating state file to the destination using FTP.

16. The air conditioning management system of claim 7, wherein the remote monitor terminal transmits login information for authentication to the server, encrypts the control command file using the login information, and transmits the control command file to the server;

the air conditioning management apparatus comprises memory means in which predetermined authentication information is stored; and when the remote communication management unit receives the control command file from the server, the remote communication management unit decrypts the control command file using the authentication information.

* * * * *